US008096054B2

(12) United States Patent
Denkert et al.

(10) Patent No.: US 8,096,054 B2
(45) Date of Patent: Jan. 17, 2012

(54) RAZOR BLADE UNIT WITH FILM HINGE

(75) Inventors: Uwe Denkert, Sonneberg (DE); Kai-Uwe Ruede, Oberwohlsbach (DE)

(73) Assignee: Feintechnik GmbH Eisfeld, Eisfeld (DE)

( * ) Notice: Subject to any disclaimer, the term of this patent is extended or adjusted under 35 U.S.C. 154(b) by 306 days.

(21) Appl. No.: 12/470,685

(22) Filed: May 22, 2009

(65) Prior Publication Data

US 2009/0288299 A1 Nov. 26, 2009

(30) Foreign Application Priority Data

May 23, 2008 (EP) ..... 08104078

(51) Int. Cl.
*B26B 21/52* (2006.01)

(52) U.S. Cl. ..... 30/50; 30/527

(58) Field of Classification Search ..... 30/41, 50, 30/527, 532

See application file for complete search history.

(56) References Cited

U.S. PATENT DOCUMENTS

| | | | | |
|---|---|---|---|---|
| 1,423,414 | A * | 7/1922 | Glaser | 30/534 |
| 3,311,975 | A * | 4/1967 | De Longuyon | 30/62 |
| 4,514,904 | A | 5/1985 | Bond | |
| 4,932,123 | A * | 6/1990 | Francis | 30/77 |
| 5,560,106 | A * | 10/1996 | Armbruster et al. | 30/527 |
| 5,661,907 | A | 9/1997 | Apprille, Jr. | |
| 5,678,316 | A * | 10/1997 | Althaus et al. | 30/527 |
| 6,029,354 | A * | 2/2000 | Apprille et al. | 30/47 |
| 6,311,400 | B1 | 11/2001 | Hawes et al. | |
| 6,381,857 | B1 | 5/2002 | Oldroyd | |
| 7,100,284 | B2 * | 9/2006 | King | 30/49 |
| 7,621,203 | B2 * | 11/2009 | Aviza | 83/13 |
| 2005/0198830 | A1 | 9/2005 | Walker | |
| 2007/0151107 | A1 | 7/2007 | Westerhof et al. | |
| 2008/0184563 | A1 * | 8/2008 | Hamadeh | 30/41 |
| 2008/0196251 | A1 * | 8/2008 | Royle | 30/50 |
| 2010/0043242 | A1 * | 2/2010 | Stevens | 30/527 |
| 2010/0281698 | A1 * | 11/2010 | King | 30/527 |

FOREIGN PATENT DOCUMENTS

| | | |
|---|---|---|
| AU | 514 532 Y | 2/1981 |
| DE | 29724245 | 9/2000 |
| DE | 69808479 | 3/2003 |
| DE | 10327739 | 1/2005 |
| EP | 0638015 | 2/1995 |
| EP | 0 960 699 A | 12/1999 |

(Continued)

*Primary Examiner* — Hwei C Payer
(74) *Attorney, Agent, or Firm* — Lucas & Mercanti, LLP; Klaus P. Stoffel

(57) ABSTRACT

A razor blade unit with a blade housing, in which several blades with cutting edges lying parallel to a skin contact plane are arranged, a coupling section, which can be connected preferably in a detachable manner to a handle, and a connecting section. The connecting section includes at least one film hinge between the blade housing and the coupling section, which hinge defines a pivot axis extending parallel to the skin contact plane, and an elastic damping component, which surrounds one or more sides of the film hinge and is formed both on the blade housing and on the coupling section. The razor blade unit also has a foam edge, arranged in front of the cutting edges (with respect to the shaving direction) of the blades to pretension the skin during shaving. The pivot axis extending through the film hinge is positioned between the forward boundary (with respect to the shaving direction) of the foam edge and the cutting edge lying closest to the foam edge.

8 Claims, 4 Drawing Sheets

FOREIGN PATENT DOCUMENTS

| | | | |
|---|---|---|---|
| EP | 1 488 894 | Y | 12/2004 |
| GB | 2 066 133 | Y | 7/1981 |
| WO | 03097310 | | 11/2003 |
| WO | 2005/072918 | Y | 8/2005 |

* cited by examiner

RAZOR BLADE UNIT WITH FILM HINGE

BACKGROUND OF THE INVENTION

The present invention pertains to a razor blade unit for a razor.

High-value conventional razor blade units are supported so that they can pivot with respect to the handle around a rotational or pivot axis which is perpendicular to the longitudinal axis of the handle. The skin-contact plane of the razor blade unit can thus be laid more effectively against the skin to be shaved during the shaving process.

DE 297 24 245 U1 refers to, among other things, a razor blade unit in which the axis of rotation is located above the cutting edges of the blades and above the housing. DE 297 24 245 U1 also describes an axis of rotation located on the cutting edge of the second blade.

EP 0 638 015 B1 describes a razor in which the axis of rotation lies either on the side of the blade unit or on the side of the blade unit opposite the razor handle relative to the shaving surface, as a result of which the axis of rotation, with respect to its location during use, lies correspondingly on or below the surface to be shaved. The blade unit carrier is supported by a four-bar linkage, which lies in a plane parallel to the edges of the blades.

A razor with a coupling, which connects the handle to the blade unit, is known from WO 2003/097,310. The blade unit can be pivoted relative to the coupling around a first axis. The coupling is supported so that it can pivot relative to the handle around a second axis, which, like the first axis, is parallel to the cutting edges. The coupling and the blade unit are held under pretension in predetermined resting positions.

DE 698 08 479 T2 discloses a blade unit engagement structure, which makes it possible for the blade unit to pivot around a pivot axis parallel to a longitudinal axis of the blade unit. The handle is connected to the blade unit engagement structure by a pair of elastically deformable arms. The arms make it possible for the blade unit engagement structure to shift downward toward the handle, wherein the movement of the blade unit engagement structure is limited in a direction perpendicular to the direction of the downward displacement.

A razor, on the forward end of the handle of which a razor blade unit is supported by a fork-like holder, is known from U.S. Pat. No. 4,514,904. Starting from a spring-loaded zero position, the blade unit can be pivoted around an axis of rotation parallel to the cutting edges. The axis of rotation defined by the fork-like holder extends under the cutting edge of the first blade.

Finally, a razor blade unit with a blade carrier which can be connected detachably to a handle by a plug connector is known from DE 103 27 739 B4, where the plug connector and the blade carrier are connected to each other by a connecting part which is designed in the form of a film hinge, and where the plug connector part and the blade carrier are also connected by an elastic plastic component, which almost exclusively determines the spring characteristic of the connection between the plug connector and the blade carrier. Although the use of the film hinge and the elastic plastic component already provide good spring and damping characteristics, there exists during the shaving process the problem that the blade carrier tilts up and lifts off the skin when too much pressure is exerted via the handle.

SUMMARY OF THE INVENTION

Against the background of DE 103 27 739 B4, the goal of the present invention is to provide an improved razor blade unit, in which precise contact of the cutting edges of the blades on the skin to be shaved is guaranteed in almost complete independence of the amount of force which the user applies to the razor.

An essential aspect of the razor blade unit of the present invention is the position of the pivot axis which extends through the film hinge. Relative to the direction of the longitudinal axis of the handle, this axis is positioned in an area which extends from the forward (forward with respect to the shaving direction) boundary of the foam edge to the cutting edge situated closest to the foam edge. Because of the way in which the film hinge is designed, locating the pivot axis in this area offers the special advantage that the introduction of a force component via the handle in the direction toward the area of skin to be shaved does not lead to the unwanted tilting-up of the blade housing, as a result of which secure contact of the cutting edges with the area being shaved is guaranteed in all cases.

An especially preferred embodiment of the razor blade unit is characterized in that the connecting section is divided into two parts and is arranged on each of the sides of the blade housing which extend transversely to the cutting edges. Each of these two connecting parts has two hinge sidepieces, which are connected to each other by a film hinge and which are preferably surrounded on all sides by an elastomeric damping component. The two film hinges designed in this way are so flexible that they are not alone enough to guarantee the transmission, from the handle to the blade housing, of the force necessary for shaving. The film hinges serve instead to connect the blade housing to the coupling section in such a way that they can pivot easily with respect to each other. The necessary spring characteristic, which allows the transmission of force and is responsible for the recovery of the blade housing back to a zero position, is provided by the elastomeric damping component. The general function of a film hinge in conjunction with the use of a damping component is known from the previously cited patent DE 103 27 739 B4, so that there is no need for a detailed explanation of it here. The contents of DE 103 27 739 B4 are incorporated herein by reference.

It is advantageous for the foam edge to consist of the same soft, elastomeric plastic as the damping component. The hard components of the blade housing, of the coupling section, and of the connecting section can also consist of a uniform, hard plastic, which is stronger than the soft plastic of the damping component and which comprises essentially no elasticity. As a result, all of the housing parts of the razor blade unit can be produced by a two-component plastic injection-molding process.

A preferred embodiment of the razor blade unit has a pivot-limiting sidepiece, which is attached either to the blade housing or to the coupling section and which cooperates with an opposing stop. The pivot angle around which the blade housing can pivot with respect to the coupling section can thus be restricted. This increases safety during shaving and avoids damage to the film hinge by unwanted overextension under the action of strong forces. The pivot angle is preferably limited to a range between 0° and 45°, based on the position of the blade housing with respect to the longitudinal axis of the handle.

It is advisable for the coupling section to comprise a sleeve, which can be set detachably onto an adapter section of the handle. The handle thus becomes reusable, and the razor blade unit can be connected to the handle quickly without the need for additional aids. Additional details on the design of the adapter section and of the handle can be derived from the detailed description of the figures. Modified embodiments, which are used in the case of, for example, disposable razors, have a nondetachable connection between the coupling section and the handle.

An especially preferred embodiment of the inventive razor blade unit comprises 5 blades, which are arranged in the blade housing, and the cutting edges of which lie essentially in the skin contact plane. To achieve especially good shaving results, the individual cutting edges can project more-or-less beyond the skin contact plane or be set back from it.

Additional advantages, details, and elaborations of the present invention can be derived from the following description, based on the drawings, of preferred embodiments of the razor blade unit and of a preferred handle.

DETAILED DESCRIPTION OF THE INVENTION

Figure 1A:
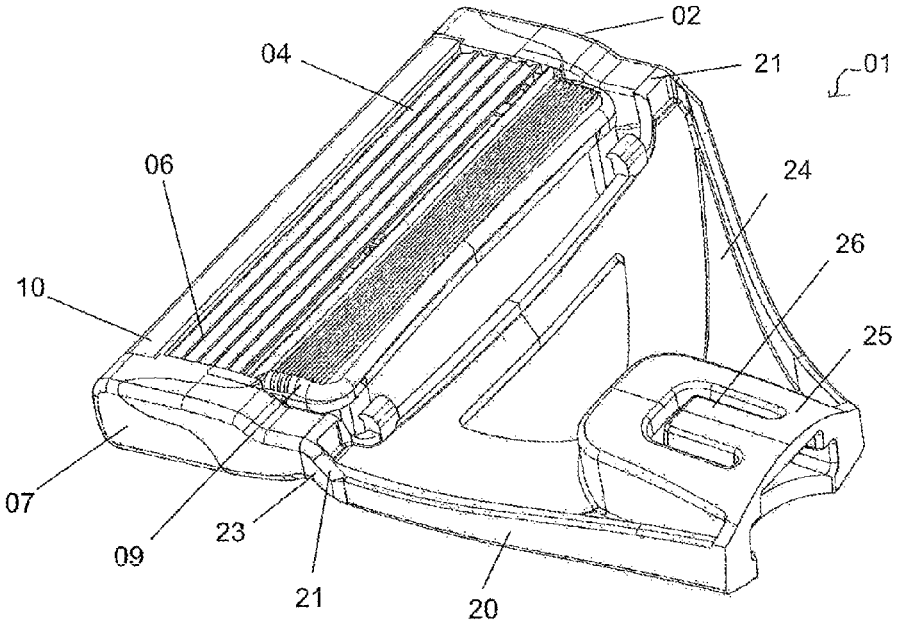
FIG. 1*a* shows a perspective view of an inventive razor blade unit from the front and FIG. 1*b* shows a view from the rear.
Figure 1B:
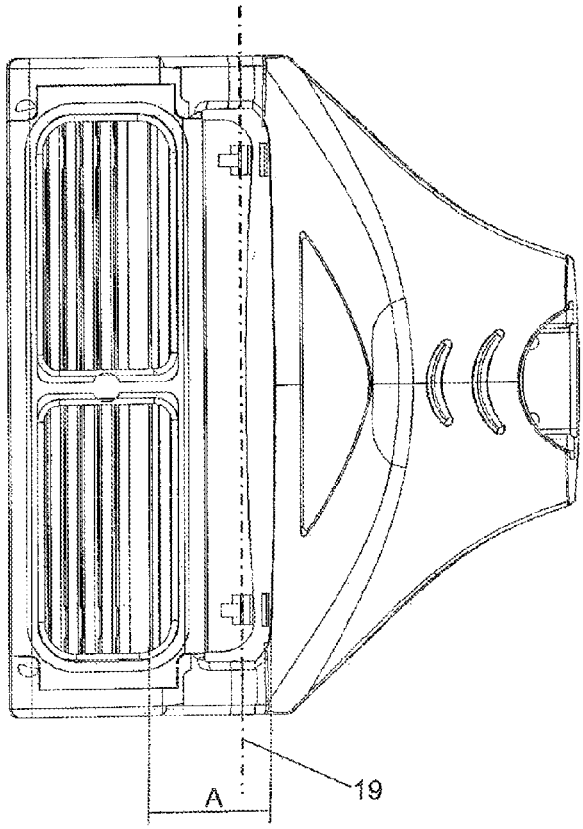
Figure 2:
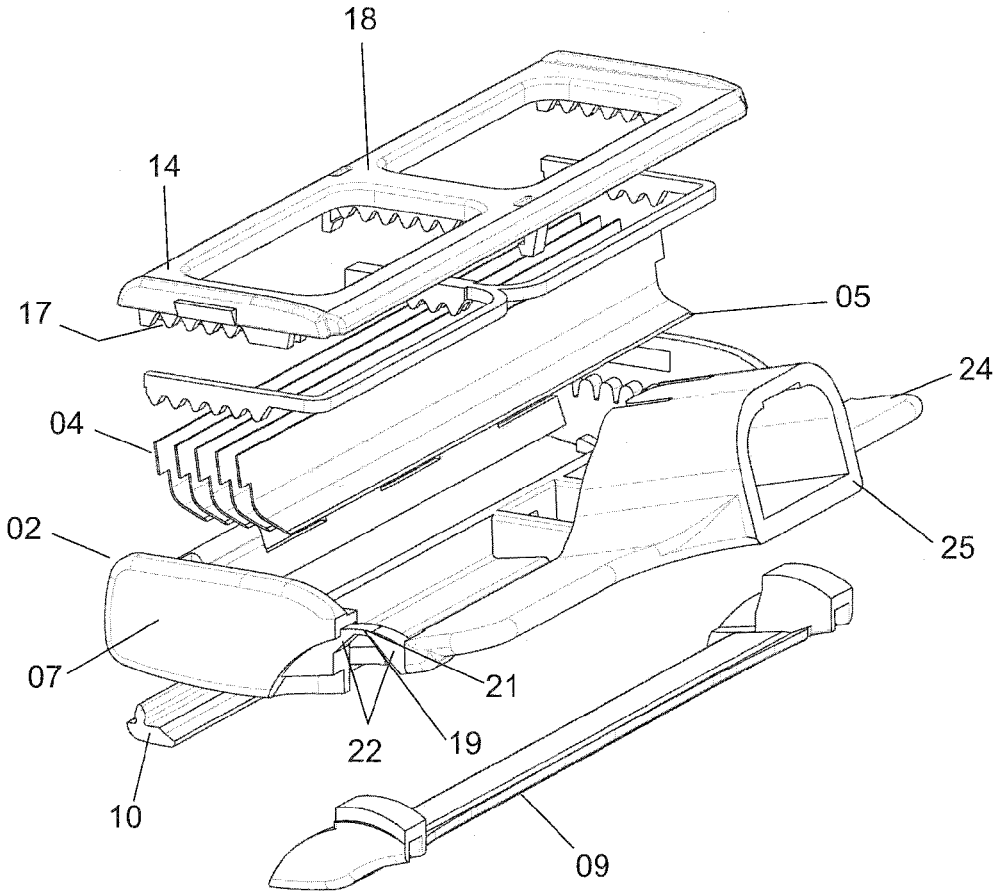
FIG. 2 shows an exploded view of a modified embodiment of the razor blade unit.

The basic design of the inventive razor blade unit is explained below on the basis of FIGS. 1*a*, 1*b* and 2, where the razor blade unit in FIGS. 1*a* and 1*b* is illustrated in the assembled state as seen from the front (upper part of the figure) and from the rear (lower part of the figure), whereas FIG. 2 shows an exploded view of a slightly modified design of the razor blade unit.

The inventive razor blade unit 01 comprises a blade housing 02, which holds several blades 04. In the embodiment shown here, the blade housing 02 serves to hold a total of five blades 04, each of which comprises a cutting edge 05. Of course, more or fewer blades can be used in the razor blade unit. In the embodiment shown, the blades 04 are designed as angled blades. The area comprising the cutting edge 05 is bent over during the blade production process at an angle of preferably about 50-70°.

The blade housing 02 leaves a window 06 open in its front surface, in which the cutting edges 05 of the blades are exposed, so that they can be brought into contact with the skin during the shaving process. The position of the cutting edges 05 defines a skin contact plane, which can also be formed with a slightly curved surface by allowing the blades to project to different degrees. The blade window 06 is bounded on the short sides by the side walls 07 of the blade housing. The blade housing is preferably made of hard plastic.

Next to the blades 04, a foam edge 09 and a slide strip 10 are also arranged on the blade housing 02. The foam edge 09, which serves to pretension the skin to be shaved, consists of an elastomeric plastic that is preferably injection-molded jointly with the blade housing 02 by means of the two-component injection-molding process. It would also be conceivable, of course, to use a separate part for the foam edge 09. The slide strip 10 comes in contact with the skin during the shaving process after the cutting edges 05 of the blades 04. Skin-care substances are contained in the slide strip 10. The slide strip 10 usually consists of a water-soluble and a water-insoluble component. Because the water-soluble component washes out during the life of the razor blade unit, it can serve as an end-of-life indicator, which informs the user that the useful life of the unit is over. The slide strip 10 is attached to the blade housing preferably by means of an adhesive.

The blade housing 02 is closed off at the back by a cover 14, which is preferably attached by a latching connection. The cover 14 is provided with recesses 17, which are located on the lateral edge areas and/or on a central web 18. Each of these recesses 17 is preferably V-shaped, and each serves to support the back edge of a blade, i.e., the edge opposite the cutting edge 05 of the blade, in the final assembled state of the razor blade unit.

The razor blade unit 01 has also a coupling section 20, which is preferably made of the same hard plastic as the blade housing 02. The coupling section 20 serves to connect, preferably in a detachable manner, the razor blade unit to a handle, the details of which are described further below. The connection between the coupling section 20 and the blade housing 02 is realized by a connecting section, which, in the present example, comprises two film hinges 21, which proceed from the two side walls 07 of the blade housing 02. As can be seen in FIG. 2, two hinge sidepieces 22 extend from the film hinge 21; although these sidepieces are considered part of the connecting section, they are preferably formed as integral parts of the adjacent blade housing 02 and the coupling section 20.

The film hinge 21 ensures that the blade housing 02 and the coupling section 20 can pivot with respect to each other, and it thus defines a pivot axis 19, which, in the embodiment shown here, extends through the two lateral film hinges 21. The pivot axis 19 lies in an area which extends from the forward boundary of the foam edge 09 (forward with respect to the shaving direction) to the cutting edge 05 lying closest to the foam edge 09. The preferred area A of the pivot axis is illustrated in the lower part of FIG. 1. Because of the way in which the film hinge is designed, locating the pivot axis in the area A offers the special advantage that the introduction of pressing force via the handle toward the skin to be shaved does not lead to an undesirable tilting-up of the blade housing 02. Secure contact of the cutting edges 05 with the surface being shaved thus remains ensured under all circumstances.

So that force can be transmitted from the coupling section 20 to the blade housing 02 and the pivotability can also be damped, the film hinge 21 is embedded in a damping component 23. The damping component 23 fills the empty space remaining between the hinge sidepieces 22 and preferably surrounds the hinge sidepieces 22 on all sides. The damping component 23 consists of an elastomeric plastic, which preferably is the same as that out of which the soft component of the foam edge 09 is made and which can be produced at the same time as that edge by the two-component injection-molding process. The spring characteristic, which determines the restoring forces for the blade housing, can be adjusted by way of the elasticity and material thickness of the damping component 23.

The coupling section 20 also comprises a support section 24 and a sleeve 25, which is integrally connected to the support section and which serves to connect the razor blade unit to the handle. The sleeve 25 has a latching element 26, which cooperates with complementary latching means on the handle.

Figure 3:
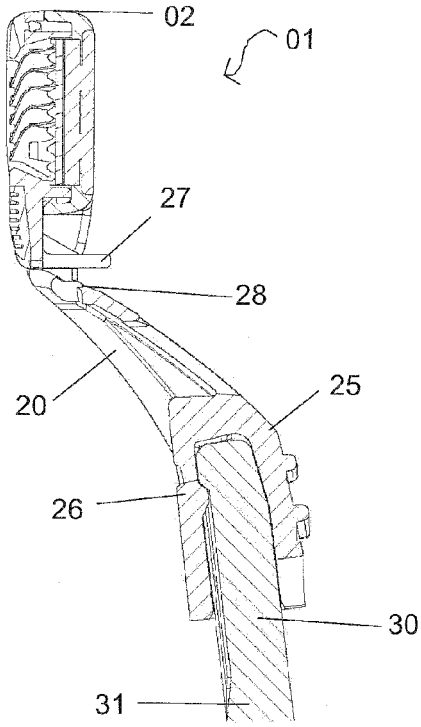
FIG. 3 shows a cross-sectional side view of the razor blade unit attached to a handle.

FIG. 3 shows a cross-sectional side view of the razor blade unit 01. The coupling section 20 is set down by the sleeve 25 onto an adapter section 30 of a handle 31. The latching element 26 is latched into a recess in the adapter section 30. In this diagram, furthermore, a pivot-limiting sidepiece 27 can also be seen, which is attached to the blade housing 02 and which, when it pivots around the pivot axis 19 and reaches a certain maximum pivot angle, comes to rest against a stop 28 on the coupling section 20, as a result of which the blade housing is prevented from pivoting any farther.

Figure 4:
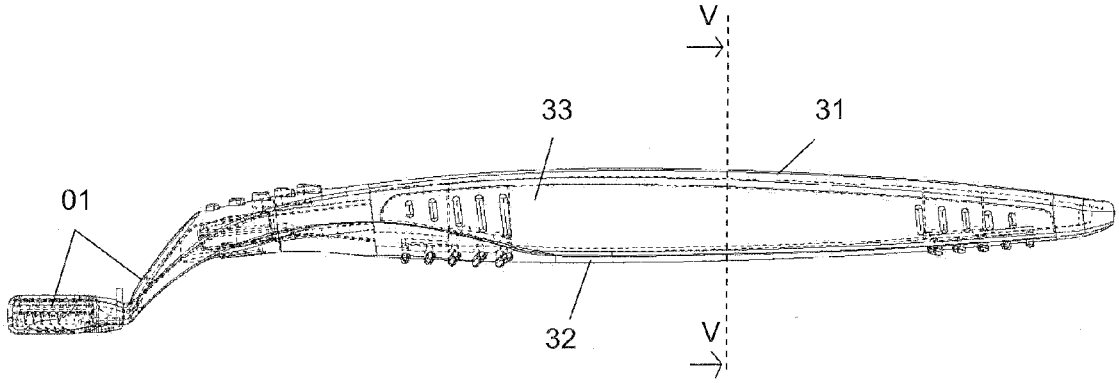
FIG. 4 shows a side view of a complete razor with handle and razor blade unit.

FIG. 4 shows a side view of a complete razor, comprising the razor blade unit 01 and the handle 31. The handle 31 has a base body 32 of a hard plastic, on the lateral surfaces of which grip sections 33 of a soft plastic component are formed.

Figure 5:
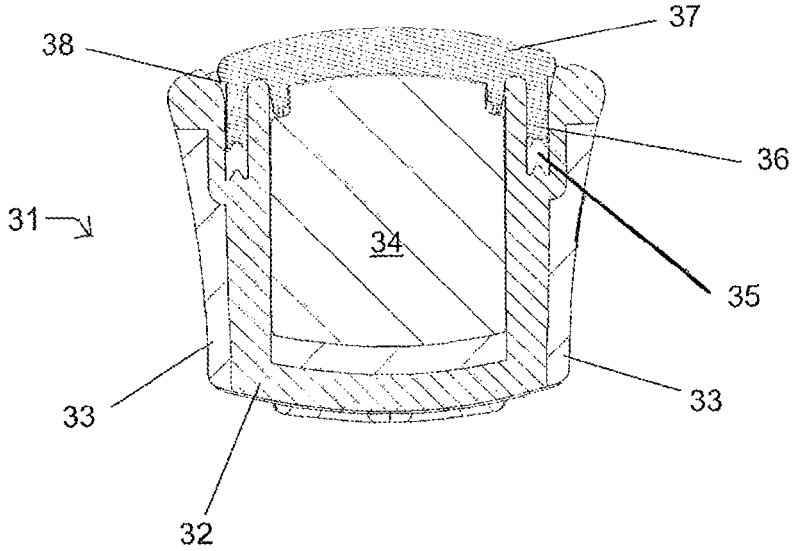
FIG. 5 shows a cross-sectional view of the handle.
Figure 6:
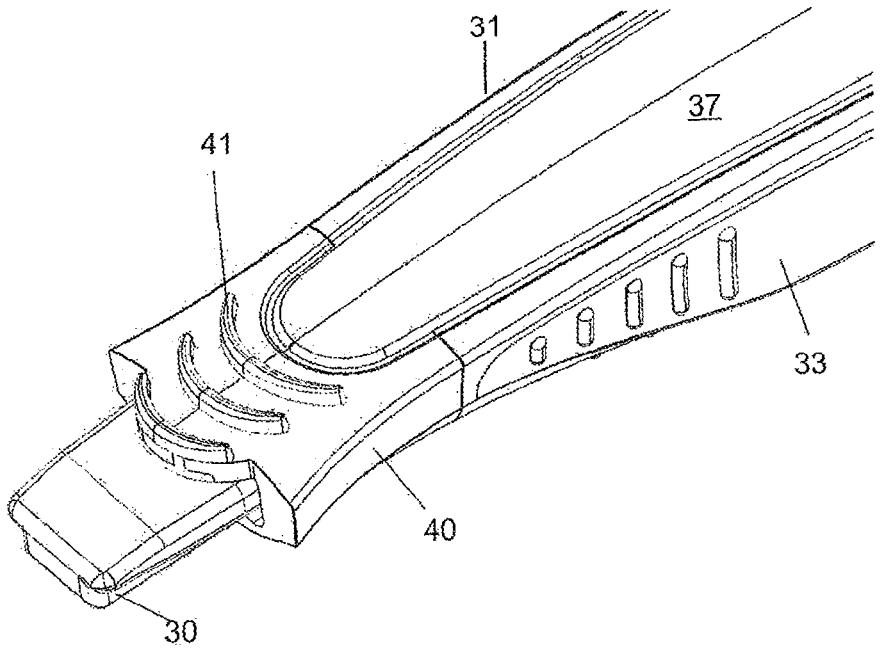
FIG. 6 shows a perspective view of a detail of the handle with the adapter section.

FIG. 5 shows a cross-sectional view of the handle 31, seen along cross-sectional line V-V indicated in FIG. 4. The base body 32 has an essentially U-shaped cross section, in which a metal weight 34 is held. The metal weight 34 preferably extends out from the forward area of the base body 32 and forms there the adapter section 30 (FIG. 6). To the left and to the right of the metal weight 34, elongated grooves 35 are introduced into the base body 32, into which retaining webs 36 of a grip cover 37 are pressed. The grip cover 37 is also made of a hard plastic and covers the entire surface of the metal weight 34. To stabilize the position of the metal weight 34, it is possible to provide elevations on the bottom surface of the grip cover 37, which engage in the metal weight 34. So that a tight connection can be established between the grip cover 37 and the base body 32, the grip cover 37 is fitted into corresponding openings in the base body 32, where preferably a sealing plate 38 is provided in the contact area, which plate is deformed when the grip cover is pressed into the base body and thus acts as a peripheral seal.

FIG. 6 shows the forward section of the handle 31 with the adapter section 30. An ejector sleeve 40, which can be slid in the axial direction, is mounted on the adapter section 30. This sleeve can be pushed by the user toward the razor blade unit to separate the connection between the sleeve 25 of the coupling section 20 and the adapter section 30. So that it can be operated more easily, the ejector sleeve 40 has a surface structuring 41 on its top surface.

Although the present invention has been described in relation to particular embodiments thereof, many other variations and modifications and other uses will become more apparent to those skilled in the art. It is preferred, therefore, that the present invention be limited not by the specific disclosure herein, but only by the appended claims.

The invention claimed is:

1. A razor blade unit comprising a blade housing, in which several blades with cutting edges lying parallel to a skin contact plane are arranged;

a coupling section, which is detachably connectable to a handle;

said blade housing comprising two side walls extending transversely to the cutting edges, each side wall having an end face arranged in a direction substantially parallel to the cutting edges;

a connecting section comprising at least one film hinge between the end faces of the side walls and the coupling section, said at least one film hinge defines a pivot axis extending parallel to the skin contact plane, and an elastic damping component, surrounding one or more sides of the at least one film hinge and said at least one film hinge being formed both on the blade housing and on the coupling section; and a foam edge, arranged in the blade housing and in front of the cutting edges of the blades with respect to a shaving direction to pretension a skin during shaving, wherein the pivot axis extending through the film hinge is positioned between a forward boundary of the foam edge with respect to the shaving direction and the cutting edge lying closest to the foam edge, wherein the at least one film hinge comprises two film hinges, and each film hinge is arranged on each end face of the side walls, and wherein each film hinge has two hinge sidepieces, which are surrounded by the damping component, extend from each film hinge.

2. The razor blade unit according to claim 1, wherein the hinge sidepieces of the film hinge consist of a hard plastic and are designed as integral parts of adjacent sections of the blade housing and the coupling section, and the damping component consists of a soft, elastomeric plastic, which surrounds the hinge sidepieces on all sides.

3. The razor blade unit according to claim 2, wherein the foam edge consists of the same soft plastic as that of the damping component and is formed on the hard plastic of the blade housing by injection-molding in a common production step with the damping component.

4. The razor blade unit according to claim 1, and further comprising a pivot-limiting sidepiece attached to the blade housing and/or to the coupling section so as to strike an opposing stop on the coupling section or the blade housing when a maximum pivot angle is reached.

5. The razor blade unit according to claim 1, wherein the blade housing is pivotable with respect to a longitudinal axis of the handle through an angle of 0-45°.

6. The razor blade unit according to claim 1, wherein the coupling section comprises a sleeve, which is detachably mountable on an adapter section of the handle.

7. The razor blade unit according to claim 1, wherein five blades are provided in the blade housing.

8. The razor blade unit according to claim 1, and further comprising a slide strip arranged after, with respect to the shaving direction, the cutting edges of the blades.

* * * * *